US008749478B1

(12) United States Patent
Bowen

(10) Patent No.: US 8,749,478 B1
(45) Date of Patent: Jun. 10, 2014

(54) LIGHT SENSOR TO ADJUST CONTRAST OR SIZE OF OBJECTS RENDERED BY A DISPLAY

(75) Inventor: James Samuel Bowen, Cupertino, CA (US)

(73) Assignee: Amazon Technologies, Inc., Reno, NV (US)

( * ) Notice: Subject to any disclaimer, the term of this patent is extended or adjusted under 35 U.S.C. 154(b) by 385 days.

(21) Appl. No.: 12/545,514

(22) Filed: Aug. 21, 2009

(51) Int. Cl.
*G09G 3/34* (2006.01)

(52) U.S. Cl.
USPC ..... 345/107

(58) Field of Classification Search
USPC ..... 345/207, 76, 77, 107
See application file for complete search history.

(56) References Cited

U.S. PATENT DOCUMENTS

| | | | | |
|---|---|---|---|---|
| 6,094,185 | A | 7/2000 | Shirriff | |
| 6,825,828 | B2 | 11/2004 | Burke et al. | |
| 7,787,169 | B2 * | 8/2010 | Abramson et al. | 359/267 |
| 2003/0142507 | A1 | 7/2003 | Sugiyama | |
| 2005/0124389 | A1 * | 6/2005 | Yang | 455/574 |
| 2005/0212824 | A1 | 9/2005 | Marcinkiewicz et al. | |
| 2006/0087245 | A1 | 4/2006 | Ng et al. | |
| 2006/0244702 | A1 * | 11/2006 | Yamazaki et al. | 345/89 |
| 2007/0001940 | A1 * | 1/2007 | Jo | 345/77 |
| 2007/0146356 | A1 * | 6/2007 | Ladouceur | 345/207 |
| 2007/0229398 | A1 * | 10/2007 | Oh | 345/44 |
| 2008/0088576 | A1 * | 4/2008 | Cato | 345/107 |
| 2008/0186259 | A1 * | 8/2008 | Todorokihara et al. | 345/76 |
| 2008/0266243 | A1 | 10/2008 | Johnson et al. | |
| 2008/0278460 | A1 | 11/2008 | Arnett et al. | |
| 2008/0291184 | A1 * | 11/2008 | Zhou et al. | 345/205 |
| 2009/0066680 | A1 | 3/2009 | Rumreich | |
| 2009/0096745 | A1 * | 4/2009 | Sprague et al. | 345/107 |
| 2009/0109145 | A1 * | 4/2009 | Okada et al. | 345/76 |
| 2009/0146992 | A1 * | 6/2009 | Fukunaga et al. | 345/214 |
| 2009/0278828 | A1 * | 11/2009 | Fletcher et al. | 345/207 |
| 2010/0103186 | A1 * | 4/2010 | Luengen et al. | 345/589 |
| 2010/0123597 | A1 | 5/2010 | Kitsukawa | |
| 2010/0149145 | A1 | 6/2010 | Van Woudenberg et al. | |
| 2010/0177076 | A1 | 7/2010 | Essinger et al. | |
| 2010/0188327 | A1 | 7/2010 | Frid et al. | |
| 2011/0037576 | A1 | 2/2011 | Jeon et al. | |

FOREIGN PATENT DOCUMENTS

| | | | |
|---|---|---|---|
| JP | 2006254304 | A | 9/2006 |

OTHER PUBLICATIONS

"Auto/Brightness/Light Sensor", Winmate Light Sensor—Panel PC, retrieved Sep. 8, 2009 from www.winmate.com.tw/light_sensor.htm, 1 pgs.

(Continued)

*Primary Examiner* — Chanh Nguyen
*Assistant Examiner* — Jonathan Blancha
(74) *Attorney, Agent, or Firm* — Lee & Hayes, PLLC

(57) ABSTRACT

Techniques and apparatuses are disclosed to adjust a visual representation of content displayed by an electronic device based at least in part on a measured light intensity. In some aspects, a light sensor may be used to measure a light intensity of ambient light. An electronic display may present a visual representation of objects including text and images. A display controller may control aspects of the electronic display based on at least the light intensity, such as a font size of the text, size of the images, or contrast of the text and the images. In further aspects, the electronic display may be an electronic paper display.

16 Claims, 6 Drawing Sheets

(56) References Cited

OTHER PUBLICATIONS

"PowerBook G4 (17-inch), (15-inch FW 800): How the Ambient Light Sensor Works", Sep. 18, 2003, retrieved from http://support.apple.com/kb/TA27057?viewlocal=en_US on Sep. 8, 2009, 1 pgs.

Office action for U.S. Appl. No. 12/973,500, mailed on Mar. 14, 2013, Manyam et al., "Display Adjustments Using a Light Sensor", 17 pages.

Office action for U.S. Appl. No. 12/973,500, mailed on Aug. 27, 2013, Manyam et al., "Display Adjustments Using a Light Sensor", 21 pages.

Office Action for U.S. Appl. No. 12/973,500, mailed on Dec. 23, 2013, Vijay Manyam, "Display Adjustments Using a Light Sensor," 23 pages.

Office Action for U.S. Appl. No. 12/973,582, mailed on Dec. 5, 2013, Vijay Manyam, "Changing Light Assembly," 13 pages.

Final Office Action for U.S. Appl. No. 12/973,582, mailed on Apr. 1, 2014, Vijay Manyam, "Portable Electronic Light Intensity Controlling Device and Method", 12 pages.

* cited by examiner

DISPLAY PROFILES 600

| LIGHT INTENSITY 602 | TEMPERATURE 604 (°F) | WAVEFORM 606 |
|---|---|---|
| .1-.3 | 0-30 | λ=a |
| .4-.6 | 0-30 | λ=a+x |
| .7-.9 | 0-30 | λ=a+y |
| .1-.3 | 31-60 | λ=b |
| .4-.6 | 31-60 | λ=b+x |
| ⋮ | ⋮ | ⋮ |
| .7-.9 | 91-120 | λ=n+y |

FIG. 6

LIGHT SENSOR TO ADJUST CONTRAST OR SIZE OF OBJECTS RENDERED BY A DISPLAY

BACKGROUND

Electronic display devices are widely used to convey information to users. This information varies from the time of day shown on a wrist watch to information from an Internet site displayed by a smart mobile telephone. Electronic display devices are used in many environments and thus operate in varying degrees of ambient light and in various temperatures. For example, a display device that operates outside near the South Pole in the winter may experience little ambient light and may be subjected to very cold temperatures. Conversely, a display device operating near the equator may experience considerably warm temperatures and plenty of ambient light from sunlight during the daytime. Unfortunately, these differing environmental conditions may affect the ability of users to view information on their electronic display devices.

BRIEF DESCRIPTION OF THE DRAWINGS

The detailed description is described with reference to the accompanying figures. In the figures, the left-most digit(s) of a reference number identifies the figure in which the reference number first appears. The same reference numbers in different figures indicate similar or identical items.

FIG. 6 is chart of illustrative display profiles that may be used to update a visual representation of content using measured light intensity of ambient light.

DETAILED DESCRIPTION

Overview

Figure 1:
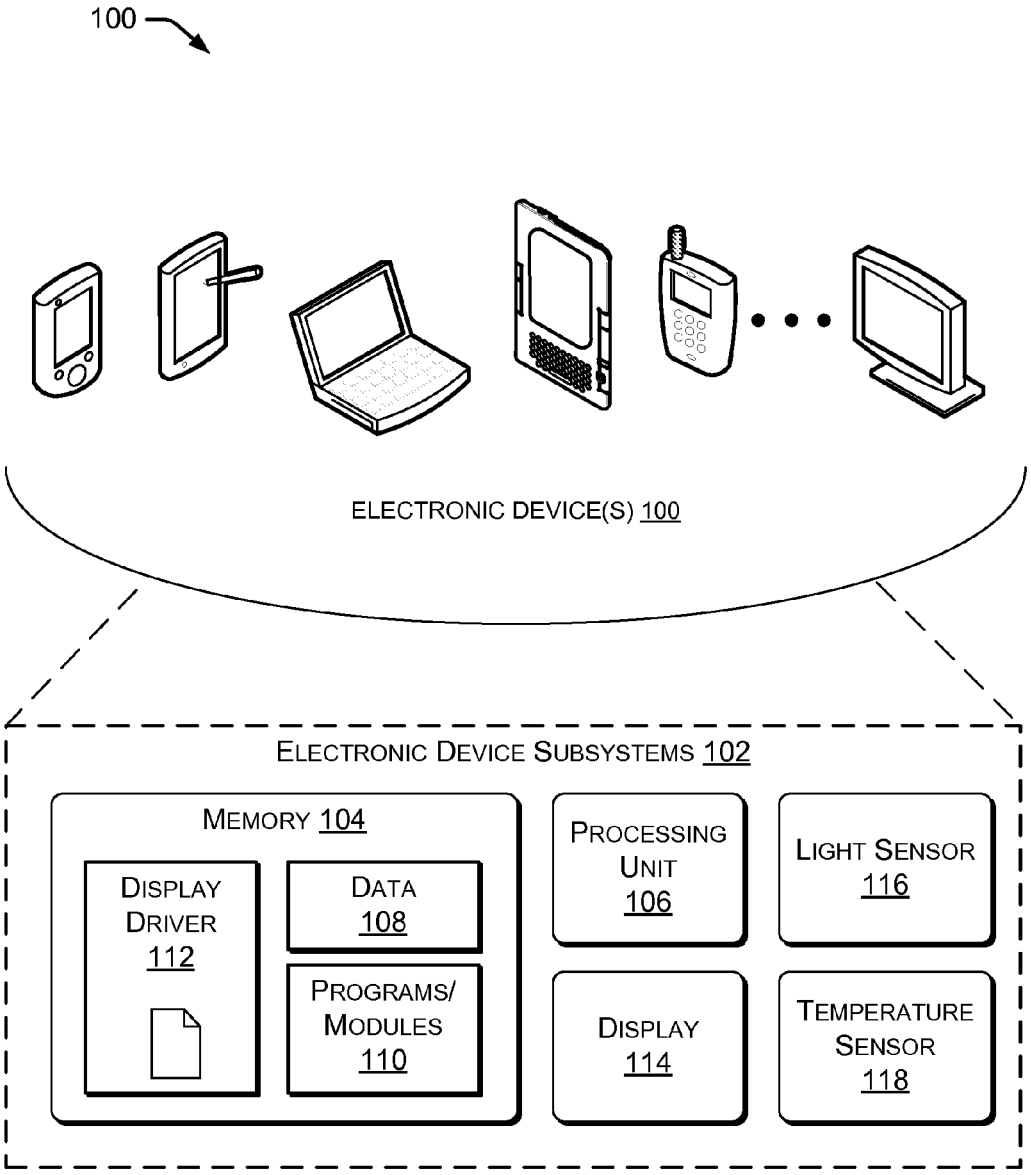
FIG. 1 is a schematic diagram of illustrative subsystems of various computing devices that render a display based on measured light intensity.

As discussed above, electronic devices may be used in various environments that may include different light intensities of ambient light. Disclosed herein are various techniques and apparatuses to adjust a display based on a measured light intensity of ambient light to improve a user's ability to view content (readable text, imagery, etc.) presented by the display. Adjustments to a visual representation of content of the display may be performed with or without user input, thereby enabling the user to avoid or reduce time spent adjusting the display. Therefore, this disclosure describes various illustrative techniques and apparatuses for providing adjustments based on measured light intensity of the ambient light to optimize a user experience viewing content on a display of an electronic device, such as an electronic book (eBook) reader device. In some implementations, a measurement of ambient light may be used to adjust an object size (e.g., font size, image size, etc.) of an object that is presented on the display. For example, when the ambient light is relatively high, the font size may be decreased (or increased in some instances), where a decrease in object size may enable more content to be presented in a display space. Conversely, when the ambient light is subsequently measured to be relatively low, the object size may be increased (or decreased in some instances) to improve detection and interpretation of the object in a low-light environment.

In various implementations, the measured ambient light may be used to adjust a contrast of the image or text that is presented on the display. For example, the electronic device may increase (or decrease in some instances) a display contrast in response to an increase in light intensity of the ambient light to improve a user's ability to view content on the display. When the display is an electronic paper display, the measured levels of ambient light may be used to modify waveform adjustments that are used to move particles through associated capsules, where the particles represent a pixel of content and the capsules are aligned substantially perpendicular (e.g., within typical manufacturing tolerances) to a display surface. As used herein, the term particle is intended to include fluid ink, spherical-shaped matter, and other matter used to visually render content in electronic paper displays. Adjustments to the waveform ultimately impact the contrast of the content presented via the display.

The display of an electronic device may be selected from various types of displays, where some displays rely on backlights in low light conditions while other displays rely on reflective light. Examples of displays that may include backlights include liquid crystal displays (LCD), plasma displays, and cathode ray displays, while examples of reflective light displays include electronic paper displays (EPD's). A change in a light intensity of ambient light may initiate a change in a rendering of content on the backlight or reflective light displays, which may include rendering that is similar or different that one another of the devices. For example, when a display includes a backlight, a presentation of content may be rendered using an increased size and/or contrast after an increase in light intensity. Conversely, when a display relies on reflective light, the presentation of content may be rendered using a decreased size and/or contrast after an increase in light intensity.

The techniques and apparatuses described herein may be implemented in a number of ways and in a number of environments. A few of many example implementations are provided below with reference to the following figures.

Illustrative Light Sensor Device

FIG. 1 is a schematic diagram of illustrative electronic display devices (or simply "devices") 100 having subsystems that render a display based at least in part on measured light intensity of ambient light. In the illustrated implementation, the devices 100 are represented by various electronic devices, each of which include a display. A non-exhaustive list of the devices 100 may include a notebook computer, a music player, a personal digital assistant (PDA), a mobile telephone (including smartphones), a tablet computer, an electronic book (eBook) reader, a netbook computer or a monitor (with or without a television tuner), and so forth. However, virtually any other type of electronic display device may be used and may be configured to adjust the rendering of content on a display based on measured ambient light using the techniques described herein.

As illustrated, the devices 100 may include electronic device subsystems 102. In some embodiments, the subsystems 102 include memory 104 and a processing unit 106. The processing unit 106 interacts with the memory 104 to facilitate operation of the electronic device 100. The memory 104, meanwhile, may be used to store data 108, such as data files, audio and/or video media, eBooks, or the like. The memory 104 may also include software programs or other executable modules 110 that may be executed by the processing unit 106. Examples of such programs or modules include indexing modules for indexing data, reader programs, control modules (e.g., power management), network connection software, an operating system, sensor algorithms, page turn detectors, and the like.

The subsystems 102 also include a display driver 112, which is an algorithm to render a visual representation of content (e.g., text, images, etc.) on a display 114 based on a measured level of ambient light and/or other inputs (e.g., user input, temperature input, etc.). In some embodiments, the display driver 112 may adjust the contrast of the content based on a measured light intensity of ambient light to improve the visibility the content. In addition or in an alternative, the display driver 112 may also adjust the size of the content based on the measured level of ambient light. For instance, the size of text (font size) and/or size of an image may be increased (or decreased in some instances) by the device 100 when a measured level of ambient light indicates that a light intensity has decreased since a previous measurement of ambient light, such as the immediately previous measurement of light.

In accordance with various embodiments, a light sensor 116 is provided to measure the light intensity of the ambient light. The light sensor 116 may generate a signal after a user command (e.g., a command to turn a page in an eBook, refresh a page, etc.), after a periodic or random duration of time, or after other events or commands. The signal may be received by the display driver 112, which may interpret the signal and adjust the display according to the measured light intensity.

In some embodiments, a temperature sensor is included in the electronic device 100 to enable adjustment of display characteristics when the electronic device is exposed to various temperatures over a period of time. Mobile electronic devices may experience large temperature changes (in excess of 50 degrees Fahrenheit) over a matter of minutes such as when a person moves the mobile electronic device outside a heated building on a cold winter day. When the display 114 is an electronic paper display, temperature may have a considerable impact on the operation of the display mechanisms (i.e., movement of particles through associated capsules to render individual pixels). An electronic paper display uses a manipulation of the particles to create a visual representation of content on the display 114. The particles are moved along associated capsules, as determined by the display driver, to render the visual representation. When the temperature is cool, the particles move slower than when the temperature is warm, which impacts the perceived contrast of the rendered visual representation. Thus, temperature, in addition or in the alternative to the measured level of ambient light, may be used by the display driver 112 to optimize the visual representation of content provided on the display 114 for consumption by a user.

The memory 104 may include volatile memory (such as RAM), nonvolatile memory, removable memory, and/or non-removable memory, implemented in any method or technology for storage of information, such as computer-readable instructions, data structures, program modules, or other data. Also, the processing unit 106 may include onboard memory in addition to or instead of the memory 104. Some examples of storage media that may be included in the memory 104 and/or processing unit 106 include, but are not limited to, random access memory (RAM), read only memory (ROM), electrically erasable programmable read only memory (EEPROM), flash memory or other memory technology, compact disk (CD-ROM), digital versatile disks (DVD) or other optical storage, magnetic cassettes, magnetic tape, magnetic disk storage or other magnetic storage devices, or any other medium which can be used to store the desired information and which can be accessed by the electronic device 100. Any such computer-readable media may be part of the electronic device 100.

Various instructions, methods and techniques described herein may be considered in the general context of computer-executable instructions, such as program modules, executed by one or more computers or other devices. Generally, program modules include routines, programs, objects, components, data structures, etc. for performing particular tasks or implementing particular abstract data types. These program modules can be implemented as software modules that execute on the processing unit 106, as hardware, and/or as firmware. Typically, the functionality of the program modules may be combined or distributed as desired in various embodiments. An implementation of these modules and techniques may be stored on or transmitted across some form of computer-readable media.

Figure 2:
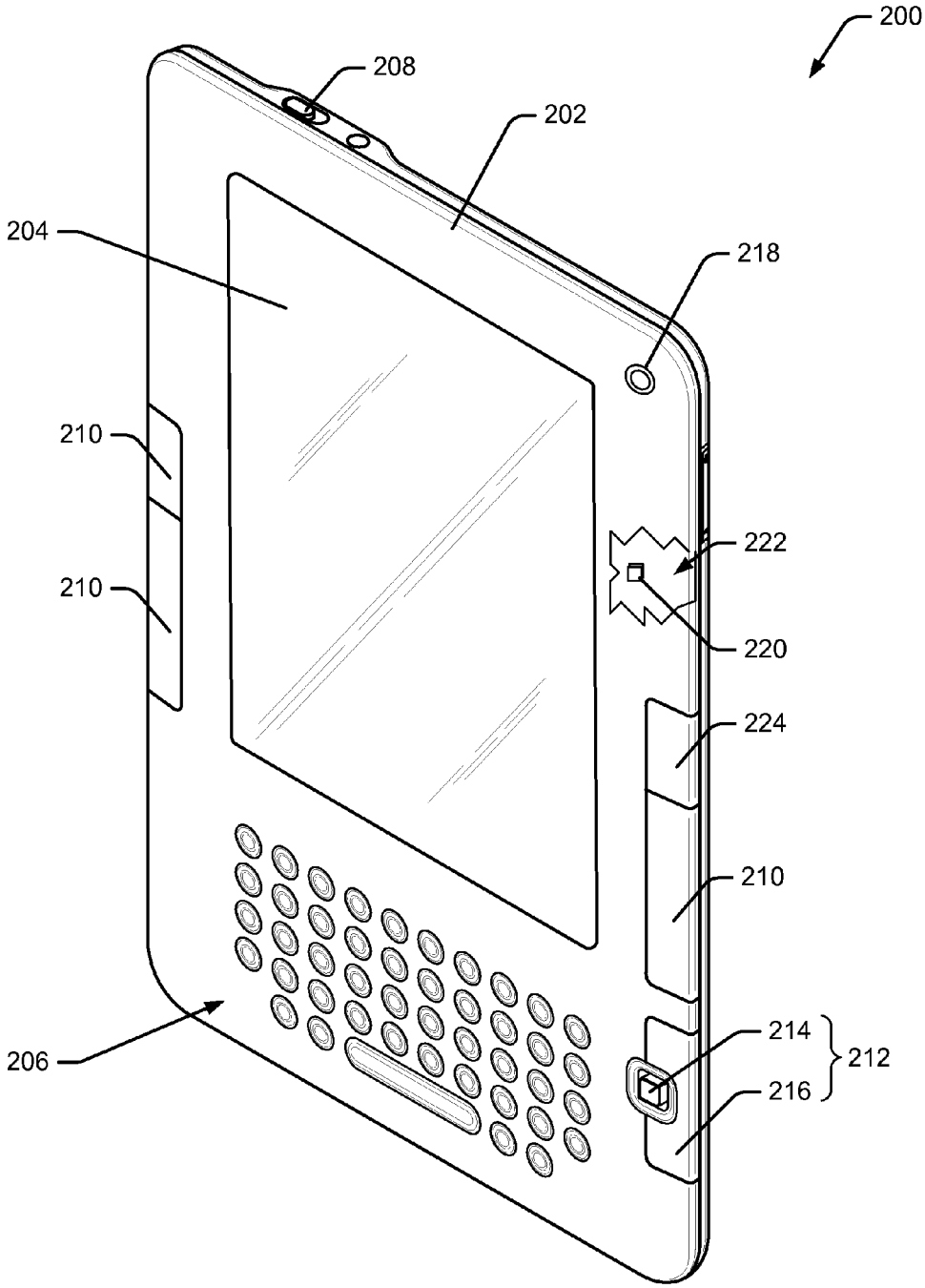
FIG. 2 is a schematic diagram of an illustrative display device that includes a light sensor to measure ambient light for adjusting display characteristics.

FIG. 2 is a schematic diagram of an eBook reader device 200 that includes a light sensor to measure ambient light for adjusting display characteristics of content rendered on the device. The eBook reader device 200 is one example of the electronic devices 100 of FIG. 1, and is used to illustrate concepts that may be applied to various other electronic display devices 100 as discussed with reference to FIG. 1.

The eBook reader device 200 has a body or housing 202, a display 204 for displaying information to a user, and a user interface to allow a user to interact with the eBook reader device. In this example, the display 204 comprises an electronic paper display, such as those made by E Ink® Corporation of Cambridge, Mass. The user interface comprises a variety of mechanisms for users to interact with the eBook reader device 200 including a keypad 206, an on/off slider 208, multiple buttons 210, and a user interface cluster 212 including a joystick 214 and a pivot button 216. In some implementations, the display 204 may also comprise a user interface mechanism in the form of a touch screen.

In accordance with one or more embodiments, the eBook reader device 200 also includes a light sensor 218 to measure light intensity of ambient light. The light sensor 218 (i.e., a photodetector) is a sensor capable of measuring light and generating a signal that may be converted to a light intensity or light value that is representative of the amount of light visible in a particular direction or space. The light sensor 218 may comprise an optical detector, a chemical detector, a photoresistor, or any other type of sensor capable of measuring light intensity. In some embodiments, the light sensor 218 may be located proximate the display 204 and directed substantially perpendicular (e.g., less than one degree from perpendicular, less than five degrees, less than 20 degrees, etc.) to a plane created by the display. In this way, the light sensor 218 may measure the intensity of light that is directed to the display 204 and that enables a user to see the content on the display.

The light sensor 218 may determine the light intensity, which may be used to adjust a visual representation of content on the display 204. In some embodiments, the light sensor 218 may measure a high light intensity and, in response, the light sensor 218 may generate a signal that is processed by the display driver 112 to increase (or decrease) the contrast and/or size of the objects in the visual representation.

As an example, a user may be viewing content on the eBook reader device 200 with a reflective light display in a location having a relatively high intensity of ambient light (e.g., outside in a sunny environment). The user may then move to a new location having less light intensity (e.g., inside a building). The techniques described above may detect a decrease in the light intensity at the new location and automatically increase the contrast and/or size of displayed objects on the reflective light display to improve the visibility of the content on the display 204 in the less intense ambient light. Thus, the techniques may enable the user to view content in the less intense ambient light at the new location that, without the techniques, would otherwise be difficult for the user to view. In some instances, the display 204 may be a backlight display and may decrease the contrast and/or size of displayed objects under similar circumstances (i.e., after a measured decrease in light intensity). Further, it is contemplated that in some instances, the size and/or contrast may be adjusted in an opposite direction (e.g., increased rather than deceased) for backlight or reflective light displays depending on various factors, such as user preferences, availability of light, remaining battery power, and so forth.

The eBook reader device 200 may also include a temperature sensor 220. The temperature sensor 220 may be located internally within the eBook reader device 200, which is illustrated via a cutout 222 in the housing 202. In some embodiments, the temperature sensor 220 may be located proximate the display 204 to measure a temperature of particles used to render a visual representation of content for an electronic paper display. A measured temperature may be used to select a waveform value, which may ultimately determine the movement of the particles that adjusts a contrast of the visual representation.

In some embodiments, the eBook reader device 200 may include a refresh button 224. The refresh button 224 may enable a user to selectively refresh (or redraw) the visual representation of content shown by the display 204. For example, the user may move the eBook reader device 200 from a low light environment to a more intense light environment and desire a refreshed display having decreased (or increased) contrast and/or object size, which may be accomplished by selecting the refresh button 224. That is, when the user selects the refresh button 224, the light sensor 218 and/or the temperature sensor 220 may measure respective parameters of the environment and may cause a contrast and/or an object size to increase or decrease based on these measurements. In other implementations, however, the light sensor 218 and/or the temperature sensor 220 may periodically or randomly measure these parameters and correspondingly adjust the contrast and/or object size without requiring the user to select the refresh button 224 at all. In various embodiments, an adjustment may be based on predefined or user adjustable threshold levels. For example, a user may select a preferred contrast and/or object size for a particular light intensity. In some embodiments, the user may calibrate the device driver 112 by selecting preferred levels of contrast, object size, or both, which may be used to determine an appropriate setting of the contrast and/or object size when the display is subjected to various levels of light intensity.

The user interface, meanwhile, allows users to display and navigate through a collection of eBooks, web pages, audio files, video files, games, programs, and/or other electronic items. As used herein, the term eBook includes electronic copies of books, magazines, newspapers, maps, publications, and other at least partially text-based electronic documents. In other implementations, user interfaces of electronic devices may include any combination of these and other user input mechanisms.

When the display 204 is an electronic paper display, the eBook reader device may provide an easy to read presentation of content that resembles an actual printed page of text. Power consumption and page turn time of the electronic paper display are influenced by a desired contrast level obtained in a visual representation of content because additional contrast is created by applying more power (constant power over a longer duration of time) to move particles along a capsule either away from the user (lighter display of a pixel) or closer to the user (darker display of the pixel). Thus, a lower contrast setting may be used to increase page turn time and reduce power consumption because a movement of the particles to create a low contrast is less than a movement to create a high contrast.

Electronic paper displays tend to have a longer display update time than other types of displays, such as cathode ray tube (CRT) displays and liquid crystal displays (LCDs). Typically, electronic paper displays have display update times greater than about 100 milliseconds, and in some implementations, these displays may have display update times greater than about 250 milliseconds. The display time correlates to the desired contrast level obtained in a visual representation of content because additional contrast is created by moving the particles further in their respective directions in the capsules to create the additional contrast, which takes additional time to complete. Even with display update times as low as about 15 milliseconds, there may be a perceptible delay between a time when a user requests an action via the user interface and a time when that action is displayed on the display 204 by moving the particles to create the visual representation of the content (e.g., the next page of an eBook, etc.).

Figure 3:
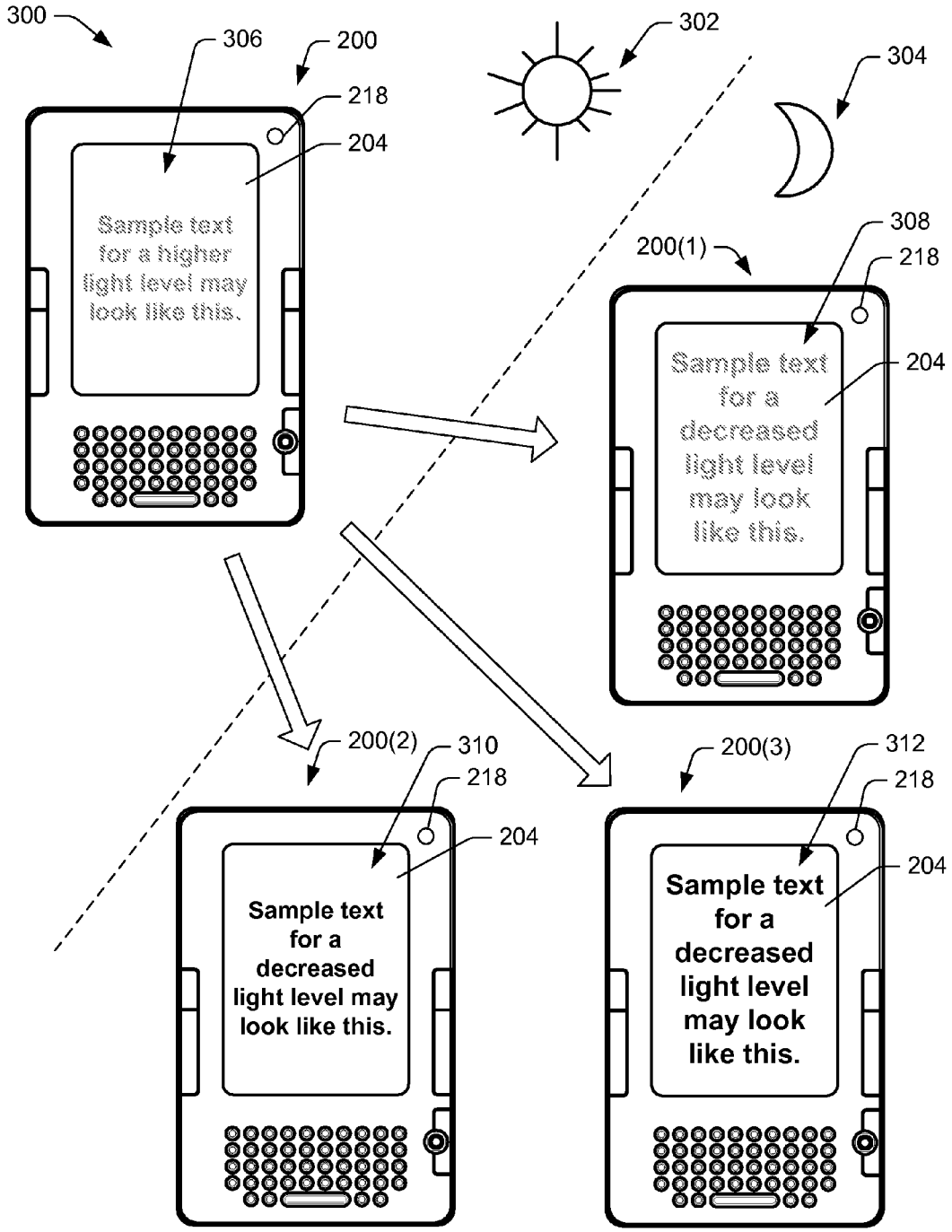
FIG. 3 is a schematic diagram showing illustrative environments that result in possible adjustments to a rendered display based on a light intensity of ambient light.

FIG. 3 is a schematic diagram showing illustrative environments 300 that result in possible adjustments to rendered content presented on an electronic paper display (using reflective light) based on a light intensity of ambient light. FIG. 3 is described in the context of a light level transition from a high light intensity environment 302 to a low light intensity environment 304. However, the discussion also applies to a light intensity transition from low light intensity to high light intensity. The light sensor 218 may measure a light intensity of ambient light in the high light intensity environment 302 (e.g., outside in sunny weather) and/or the low light intensity environment 304 (e.g., indoors, shaded location, etc.).

In the high light intensity environment 302, the eBook reader device 200 (or other electronic device 100 of FIG. 1) may include a visual representation of content as a rendered display 306. The rendered display 306 includes attributes such as a contrast setting and size of object (e.g., text, images, etc.). For example, text of the rendered display 306 may have a default font of 12 points (12 pt) and a contrast setting (ratio) of 0.6. The contrast may be measured using an illustrative contrast ratio ranging between 0 and 1, where 0.1 is a low contrast (e.g., dark grey text with light grey background) and 0.9 is a high contrast (e.g., black text with white background).

When the eBook reader device 200 is moved from the high light intensity environment 302 to the low light intensity environment 304, the rendered display 306 may be refreshed or drawn (e.g., via a page turn, etc.) to produce a first rendered display 308 shown in the eBook reader device 200(1). The first rendered display 308 may include text having a font size (e.g. 14 pt) that is greater than the font size in the rendered display 306 (e.g., 12 pt). Similar to a change in the size of the text, other objects (e.g., images, tables, or other visual representations) may be enlarged (or reduced) based on the light intensity measured by the light sensor 218. Increasing a size of objects may reduce the amount of content that may be displayed on the display 204. Thus, the size of the objects may be reduced when the user returns the eBook reader device 200(1) to the high light intensity environment 302.

In some embodiments, when the eBook reader device 200 is moved from the high light intensity environment 302 to the low light intensity environment 304, the rendered display 306 may be refreshed or drawn (e.g., via a page turn, etc.) to produce a second rendered display 310 shown in the eBook reader device 200(2). The second rendered display 310 may include an object (e.g., text, image, etc.) having a contrast (e.g., 0.8) that is greater than the contrast in the rendered display 306 (e.g., 0.06). In this way, a user may be able to better see the text or imagery in the low light intensity environment 304 than would be possible had the contrast not been increased. However, adjusting the contrast may require additional delay when a page is refreshed or drawn. Therefore, the contrast may be lowered when the user returns the eBook reader device 200(2) to the high light level environment 302 to reduce the page turn delay and save power, which is consumed when a page is refreshed or redrawn.

In various embodiments, when the eBook reader device 200 is moved from the high light intensity environment 302 to the low light intensity environment 304, the rendered display 306 may be refreshed or redrawn (e.g., via a page turn, etc.) to produce a third rendered display 312 shown in the eBook reader device 200(3). The third rendered display 312 may include size adjustments discussed with respect to the dynamic size rendered display 308 and contrast adjustments discussed with respect to the dynamic contrast rendered display 310.

Illustrative Operation

Figure 4:
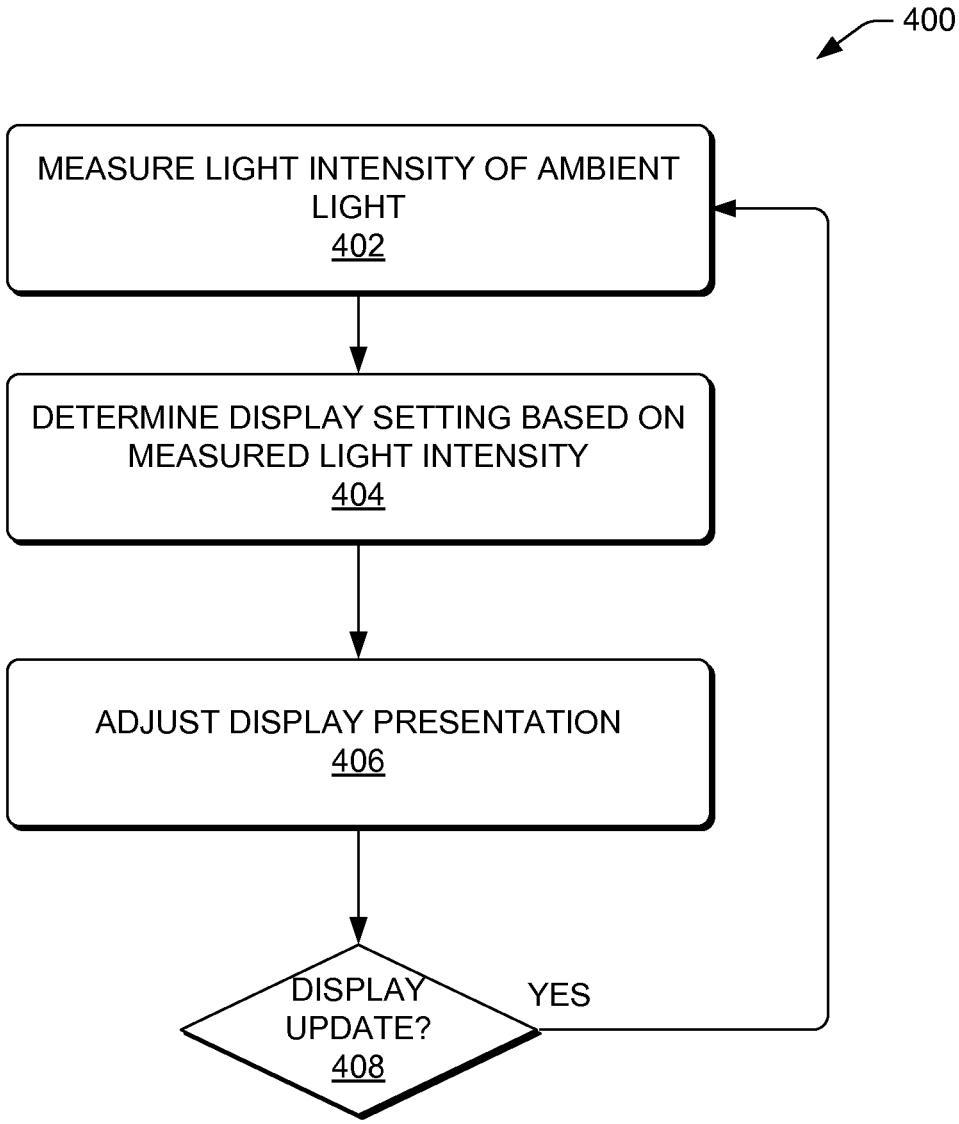
FIG. 4 is a flow diagram of an illustrative process to adjust display settings based on measured light intensity.

FIG. 4 is a flow diagram of an illustrative process 400 to adjust display settings based on measured light intensity of ambient light. The process 400 is illustrated as a collection of blocks in a logical flow graph, which represent a sequence of operations that can be implemented in hardware, software, or a combination thereof In the context of software, the blocks represent computer-executable instructions that, when executed by one or more processors, cause the one or more processors to perform the recited operations. Generally, computer-executable instructions include routines, programs, objects, components, data structures, and the like that perform particular functions or implement particular abstract data types. The order in which the operations are described is not intended to be construed as a limitation, and any number of the described blocks can be combined in any order and/or in parallel to implement the process. Other processes described throughout this disclosure, in addition to process 400, shall be interpreted accordingly. The process 400 is described with reference to FIG. 1, and more specifically, to the electronic display device(s) 100.

At 402, the light sensor 116 may measure a light intensity of ambient light proximate the electronic display device 100. The light sensor 116 may be directed substantially perpendicular to a plane defined by the display 114 of the computing device to measure the intensity of light that is projected toward the display. In some embodiments, the measurement of the light intensity may be used to create a running average light intensity value that is representative of the light intensity over a short period of time. For example, when the light sensor is subjected to inconsistent levels of light (e.g., under a tree during a windy and sunny day), then an average measured light intensity over a time period maybe used as the measured light intensity to reduce or minimize abrupt changes to the presentation of the content.

At 404, the display driver 112 may determine a display setting based on the light intensity that is measured at the operation 402. For example, the light sensor 116 may generate an electronic signal representative of the light intensity. The display driver 112 may interpret the electronic signal to determine whether it represents a higher or lower light intensity than a previously measured light intensity.

At 406, the display driver 112 may adjust a rendered display of a visual representation of content shown by the display 114. For example, when the measured level of ambient light has decreased since a previous measurement, then the display driver 112 may increase the contrast and/or the size of objects of the rendered display. Similarly, when the measured level of ambient light has decreased since the previous measurement, the display driver 112 may increase the contrast and/or the size of the objects of the rendered display.

At 408, the display driver 112 may determine whether an update to a visual representation of content of the display is to occur, which may result in another measurement of the ambient light at the operation 402. The decision 408 may occur when a user requests a new page using an eBook reader device (e.g., the eBook reader device 200), requests a page refresh, periodically (e.g., using a fixed or variable time interval), randomly, or using other controls.

Figure 5:
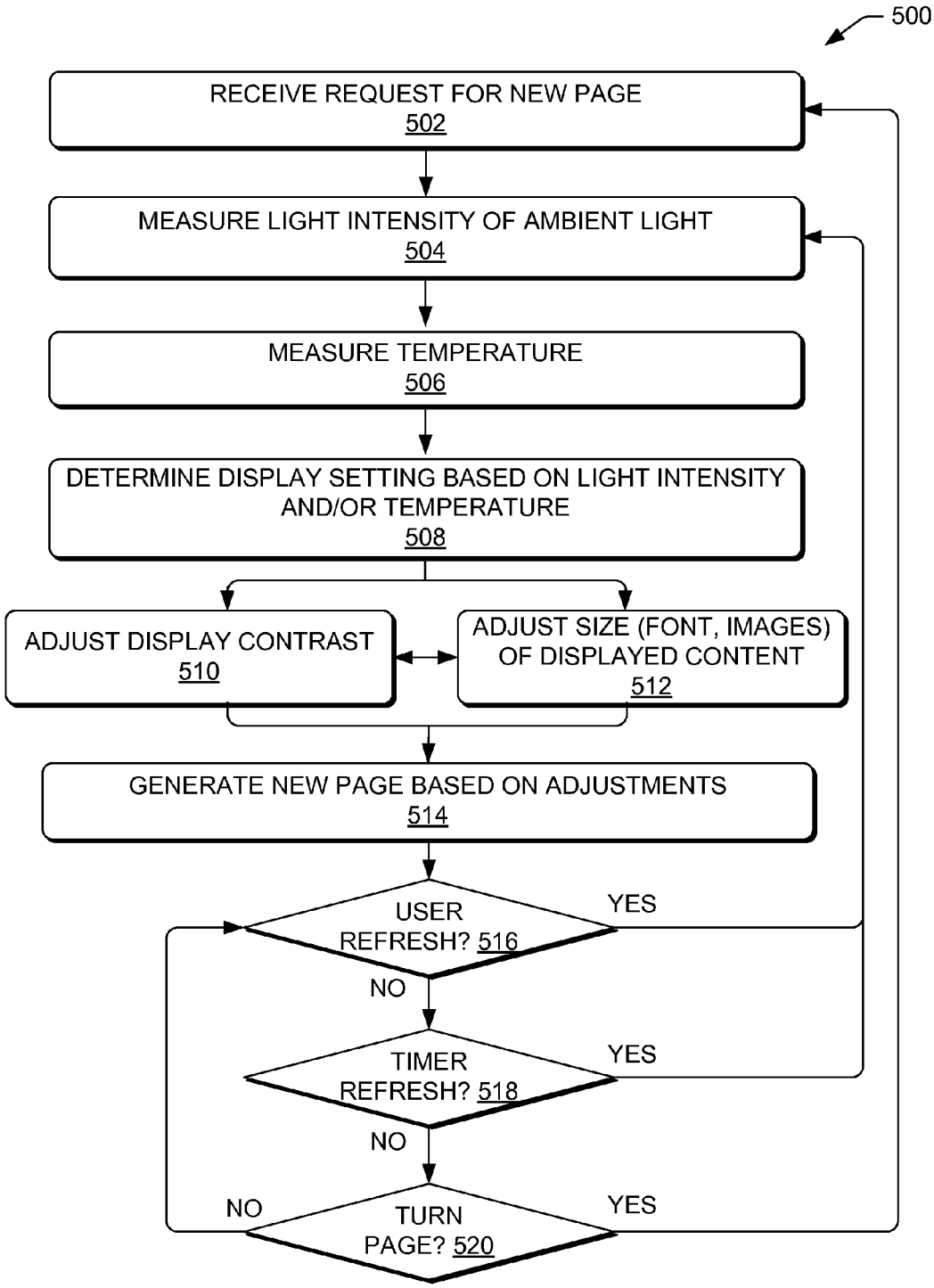
FIG. 5 is a flow diagram of an illustrative process to adjust an electronic paper display based on measured ambient light and temperature.

FIG. 5 is a flow diagram of an illustrative process 500 to adjust an electronic paper display based on measured ambient light and temperature. The process 500 is described with reference to FIG. 1 and FIG. 2, and more specifically, to the eBook reader device 200.

At 502, the eBook reader device 200 may receive a request for a new page. For example, a user may press an input button of the multiple buttons 210 to request a new page of media content (e.g., book, magazine, newspaper, web page, etc).

At 504, the light sensor 116 may measure a light intensity of ambient light proximate the eBook reader device 200. At 506, the temperature sensor 118 may measure a temperature proximate the eBook reader device 200. For example, the temperature sensor 118 may be located proximate the display 114 to enable an approximate temperature measurement of the particles that are used to generate a visual representation of content.

At 508, the display driver 112 may determine a display setting based at least in part on the measured light intensity at the operation 504 and/or the measured temperature at the operation 506. For example, a measurement of an increased temperature may result in shorter page-draw duration (waveform selection) because the particles may become less viscous in the increased temperature and move faster during a refresh or draw of a new page (e.g., page turn). In addition, a measured light intensity may trigger additional use of a higher contrast ratio via the display driver 112 by increasing the movement of the particles using a longer page turn duration. Thus, the display driver 112 may determine a cumulative display adjustment based on changed temperature and light levels.

At 510, the display driver 112 may adjust the size of objects of the visual representation of content made visible via the display 114. For example, the font size of content may be decreased when an increase in a level of light is detected by the light sensor 116.

At 512, the display driver 112 may adjust a contrast of objects of the visual representation of content made visible via the display 114. For example, the contrast of content may be decreased when an increase in a level of light is detected by the light sensor 116.

At 514, the display driver 112 may generate a new page based on the adjustments of the operations 510 and/or the operation 512. In addition, the display driver 112 may use the measured temperature at the operation 506 to adjust a waveform associated with the particles to compensate for increased or decreased viscosity due to a decrease or increase in temperature, respectively.

At 516, the eBook reader device 200 may determine, via an input, whether the user desires a refresh operation. When the user triggers a refresh, such as by selecting the refresh button 224 or by taking other actions that initiate a refresh of the visual representation of the content, the process 500 may proceed to the operation 502.

At 518, the eBook reader device 200 may determine, via a timer of the display driver, whether a refresh operation may be performed on a periodic interval. For example, after a fixed interval of time, the timer of the display driver 112 may trigger a refresh of the visual representation of the content and the process 500 may proceed to the operation 502.

At 520, the eBook reader device 200 may determine whether the user has requested a new page. When a new page request is received, the process 500 may proceed to the operation 502. Absent a new page request, the eBook reader device 200 may continue to loop the process 500 at the operation 516 to determine whether a refresh may take place via a user-initiated command (the operation 516) or system-initiated command (the operation 518).

FIG. 6 is chart of illustrative display profiles 600 that may be used to update a visual representation of content using measured light intensity of ambient light. The display profiles 600 may include inputs for the eBook reader device 200, which may be used to implement the process 500 that is shown in FIG. 5. The display profiles 600 may include a light intensity 602, a temperature 604, and a waveform 606. The values shown in FIG. 6 are for illustrative purposes only. The waveform 606 may include numeric values.

In accordance with some embodiments, the light intensity 602 may be measured by the light sensor 116 while the temperature 604 may be measured by the temperature sensor 118. The waveform 606 may be based on the light intensity 602 and/or the temperature 604. For example, the waveform may be calibrated to produce a desired visual representation of content based on unique properties of the particles while the waveform may be adjusted to provide desirable contrast for various values of the light intensity 602. In some embodiments, the display profiles 600 may include ranges of values for each of the light intensity 602, the temperature, 604, and the corresponding waveform 606.

CONCLUSION

Although the subject matter has been described in language specific to structural features and/or methodological acts, it is to be understood that the subject matter defined in the appended claims is not necessarily limited to the specific features or acts described. Rather, the specific features and acts are disclosed as illustrative forms of implementing the claims.

What is claimed is:

1. An electronic paper display device, comprising:

a light sensor to measure a light intensity of ambient light;

memory to store instructions that, when executed on one or more processors, are operable to cause the light sensor to measure the light intensity of the ambient light in response to receiving a user request to turn a page;

an electronic paper display configured to present a visual representation of content by selectively moving particles through associated capsules, each particle and associated capsule representing a pixel of the content and the capsules being aligned substantially perpendicular to a display surface of the electronic paper display; and a display controller in communication with the electronic paper display and the memory to adjust the movement of the particles based at least in part on the light intensity value, wherein the display controller selects a waveform corresponding at least in part, to the light intensity value to adjust a contrast of rendered content, the waveform comprising an input that determines a duration of the movement of the particles, the display controller further implementing a page turn duration based at least in part on the waveform, the page turn duration corresponding to a maximum movement of the particles that are selectively moved in the electronic paper display.

2. The electronic paper display device as recited in claim 1, further comprising:

a temperature sensor to measure a temperature of an environment proximate to the electronic paper display; and wherein the display controller further adjusts the movement of the particles based at least in part on the temperature.

3. The electronic paper display device as recited in claim 1, wherein the light sensor is located proximate to the electronic paper display to measure ambient light from a direction substantially perpendicular to a planar surface defined by an exterior surface of the electronic paper display.

4. The electronic paper display device as recited in claim 1, wherein the movement of the particles is adjusted to modify a contrast or a size of the visual representation of the content.

5. A method implemented by an electronic device, the method comprising:

receiving a user input that associates a contrast of an object displayed on a display device with a preferred light intensity value;

measuring a light intensity of ambient light proximate to the display device at least partly in response to receiving a user request to turn a page;

determining a measured light intensity value based at least in part on the measurement of the light intensity;

adjusting, via a display controller, the contrast of the object displayed on the display device based at least in part on the measured light intensity value and the user input, the display controller selecting a waveform corresponding to the measured light intensity value to adjust the contrast of the object displayed, the waveform determining a duration of movement of individual particles within respective capsules; and updating, via the display controller, a page turn duration based at least in part on the waveform, the page turn duration corresponding to a maximum movement of the particles that are selectively moved in the display device.

6. The method as recited in claim 5, wherein the adjusting comprises adjusting a font size or an image size of the object displayed on the display device.

7. The method as recited in claim 5, wherein the adjusting comprises increasing the contrast rendered on the display device that uses a backlight or decreasing the contrast rendered on the display device that uses reflective light when the measured light intensity value is higher than a previously determined light intensity value.

8. The method as recited in claim 5, wherein the display device comprises an electronic paper display device.

9. The method as recited in claim 8, further comprising:

measuring a second light intensity of the ambient light at least party in response to receiving a user input to refresh a rendered display;

determining a weighted average measured light intensity value based at least in part on a weighted average of the measured light intensity and second measured light intensity; and adjusting the contrast of the rendered display based at least in part on the weighted average measured light intensity value and the user input.

10. One or more computer-readable media storing computer-executable instruction that, when executed, cause one or more processors to perform the method of claim 5.

11. A system comprising:

one or more processors;

a light sensor to measure a light intensity of ambient light;

a display to render a visual presentation of content; and memory to store instructions that, when executed on the one or more processors, are operable to:

receive at least two light intensity values corresponding to separate measurements of the light intensity that is measured by the light sensor at least partly in response to a user request to turn a page;

determine a light intensity value based at least in part on the at least two light intensity values;

determine, based on user input, a preferred contrast of the content that is associated with the light intensity value;

adjust, via a display controller, a current contrast of the content rendered on the display to the preferred contrast, the display controller selecting a waveform corresponding to the light intensity value to adjust a contrast of rendered content, the waveform determining a duration of the movement of individual particles within respective capsules; and adjust, via the display controller, a page turn duration based at least in part on the waveform, the page turn duration corresponding to a maximum movement of the individual particles that are selectively moved in the display to render the visual presentation of the content.

12. The system as recited in claim 11, wherein the display comprises an electronic paper display.

13. The system as recited in claim 11, wherein the individual particles comprise ink.

14. The system as recited in claim 11, wherein the waveform is selected after receiving a request to turn a page to render a new visual presentation of content.

15. The system as recited in claim 11, further comprising a temperature sensor to measure a temperature, and wherein the instructions stored in memory are further operable to adjust the current contrast of the content rendered on the display based at least in part on the temperature.

16. The system as recited in claim 15, wherein the adjustment of the current contrast of the content rendered on the display includes:

selecting the waveform based at least in part on the temperature measured by the temperature sensor and the light intensity measured by the light sensor, where a greater light intensity results in a decrease in contrast.

* * * * *